United States Patent [19]

Gunderson et al.

[11] Patent Number: 4,907,914

[45] Date of Patent: Mar. 13, 1990

[54] TETHER CONNECTOR FOR A TENSION LEG PLATFORM

[75] Inventors: Richard H. Gunderson; Terry N. Gardner; Thomas G. A. Choate, all of Houston, Tex.

[73] Assignee: Exxon Production Research Company, Houston, Tex.

[21] Appl. No.: 229,594

[22] Filed: Aug. 8, 1988

Related U.S. Application Data

[63] Continuation of Ser. No. 48,277, May 11, 1987, abandoned.

[51] Int. Cl.[4] ..... E02D 5/74

[52] U.S. Cl. ..... 405/224; 403/322; 405/195; 166/340; 114/294

[58] Field of Search ..... 405/203, 204, 224, 195, 405/190, 188; 114/294; 166/341, 343, 338; 403/322

[56] References Cited

U.S. PATENT DOCUMENTS

| | | | |
|---|---|---|---|
| 3,248,129 | 4/1966 | Brown | 403/349 X |
| 4,023,371 | 5/1977 | Bryant | 405/224 |
| 4,053,023 | 10/1977 | Herd et al. | 175/7 |
| 4,068,729 | 1/1978 | Peevey | 175/8 |
| 4,174,011 | 11/1979 | Zaremba | 166/341 |
| 4,271,908 | 6/1981 | Robinson et al. | 166/315 |
| 4,320,993 | 3/1982 | Hunter | 405/224 |
| 4,439,055 | 3/1984 | Quigg et al. | 403/330 |
| 4,459,931 | 7/1984 | Glidden | 114/230 |
| 4,459,933 | 7/1984 | Burchett | 405/224 X |
| 4,498,814 | 2/1985 | Brake | 405/224 |
| 4,516,882 | 5/1985 | Brewer | 405/224 |
| 4,611,953 | 9/1986 | Owens | 405/224 |
| 4,668,119 | 5/1987 | Galletti | 403/349 |

FOREIGN PATENT DOCUMENTS

| | | |
|---|---|---|
| 2032561 | 4/1983 | United Kingdom . |
| 2178101 | 9/1988 | United Kingdom . |

OTHER PUBLICATIONS

Catalog Illustration, Vetco General Catalog 1980–1981; p. 7198 of the Composite Catalog of Oil Field Equipment and Services, Gulf Publishing Co., 1980.

*Primary Examiner*—Dennis L. Taylor

*Attorney, Agent, or Firm*—Richard F. Phillips; Todd N. Hathaway; Keith A. Bell

[57] ABSTRACT

A releasable latch-type connector for a tension leg platform tether. A tether portion of the latch is provided with an annularly arranged set of shear lugs. The tether portion of the latch is adapted to be received within a generally cylindrical second portion of the latch. The second portion of the latch is also provided with an annularly arranged set of shear lugs. The two sets of shear lugs are arranged so that the tether portion of the latch may be inserted into the second portion of the latch and then rotated and lifted to cause the two sets of shear lugs to come into abutment, preventing further withdrawal of the tether portion of the latch. This connector is particularly well suited for securing the lower end of a tension leg platform tether to a foundation on the ocean bottom.

19 Claims, 3 Drawing Sheets

TETHER CONNECTOR FOR A TENSION LEG PLATFORM

This application is a continuation application Ser. No. 048,277, filed May 11, 1987, now abandoned.

TECHNICAL FIELD

The present invention relates generally to mechanical connectors. More specifically, the present invention concerns a connector adapted for securing a tension leg platform tether to a tension leg platform hull or foundation element.

BACKGROUND OF THE INVENTION

Substantially all offshore oil and gas production is conducted from rigid concrete or steel structures fixedly secured to the ocean bottom and extending upward to a work deck above the ocean surface. These structures are provided with sufficient rigidity and foundation strength to resist waves, ocean currents and wind without significant motion. For relatively shallow depths, these conventional rigid structures have proven a reliable and economic means for tapping marine hydrocarbon reserves. However, in recent years, the search for offshore oil has extended into water depths in excess of 300–400 meters. At these depths, providing a production structure with sufficient rigidity and foundation strength to resist motion under the action of environmental forces requires a massive, often prohibitively expensive design. Because of this, much recent work has been performed to develop drilling and production structures which avoid the depth sensitivities inherent to conventional rigid structures.

One of the most promising concepts for structures useful in deep water offshore areas is the tension leg platform. Tension leg platforms are designed to have a compliant rather than rigid response to environmental forces. Under the action of waves, wind, and ocean currents, a tension leg platform undergoes limited, long period motion. By avoiding a need for structural rigidity, significantly less structural material is required than would be necessary for a conventional rigid structure, resulting in decreased cost.

A typical tension leg platform is illustrated in FIG. 1. Tension leg platforms have a buoyant main body (the "hull") which floats at the ocean surface and supports the drilling rigs and other equipment used in drilling and production activities. The hull is secured to a foundation on the ocean floor by a set of tethers. The length of the tethers from the ocean floor to the hull is carefully adjusted to ensure that the hull is maintained at a somewhat greater draft than would be the case were the hull unrestrained. The resulting buoyant force of the hull exerts an upward load on the tethers, maintaining them in tension. The tensioned tethers substantially restrain the hull from pitch, roll and heave motions induced by waves, ocean currents and wind. By relying on a tensile rather than compressive loading of the structure securing the hull to the ocean floor, the depth sensitivities inherent to conventional structures are largely avoided. It has been suggested that tension leg platforms could be employed in depths up to 3000 meters (9840 feet), whereas the deepest present application of a conventional rigid structure is in a water depth of approximately 412 meters (1350 feet).

Though tension leg platforms avoid many of the disadvantages inherent to conventional rigid structures in deep water, they do present several unique design problems. One of these has centered on the development of a connector which will allow the tether to be secured to and removed from the ocean floor foundation. Because of the great water depths at the installation location, the connector must be remotely operable. The connector must also be adapted to permit the tethers to be repeatedly disconnected and reattached over the life of the structure for tether inspection and maintenance. Because the location of the connector makes maintenance difficult, it should also be mechanically simple. Further, the great length and mass of the tether greatly complicates manipulation of the tether, placing a premium on simplicity of connector operation. Thus, a stab-type connector is generally preferred over, for example, a threaded connector. It is also necessary, of course, that the connector be rugged and of sufficient strength to support the considerable loads which must be transferred from the hull to the foundation.

One concept for a tension leg platform tether connector is set forth in U.S. Pat. No. 4,459,933, issued July 17, 1984. This connector uses a hydraulically operated collar to push spacer blocks between a load ring on the connector element at the base of the tether and a load ring on a tether receiving chamber secured to the ocean floor foundation. The tether is released by retracting the collar. Though this connector is effective, its reliance on hydraulic power presents a significant disadvantage. Failure of the hydraulic operator would delay, and could prevent, removal of the tether. Additionally, the need to transmit hydraulic power from the hull to the tether bottom complicates tether design and handling.

It would be desirable to develop a connector which would permit a tension leg platform tether to be remotely and easily secured to and removed from a foundation template at the ocean bottom without the need for powered actuators.

SUMMARY OF THE INVENTION

A mechanical connector is set forth which is particularly well suited for use in securing the tethers of a tension leg platform to a foundation at the ocean floor. In the preferred embodiment, the connector has two principal components, a tether latch element secured to the lower end of the tether, and a base latch element secured to the foundation. The base latch element preferably assumes the form of a sleeve with an annularly arranged set of shear lugs projecting radially inward from its inner surface. The tether latch element has a generally cylindrical main body with a set of shear lugs projecting radially outward therefrom. In the latched condition, the tether latch element is received within the base latch element with the upper surface of the tether latch shear lugs abutting the lower surface of the base latch shear lugs. This locks the tether against upward movement relative to the base latch. Gaps are provided between adjacent shear lugs on both sets of shear lugs to establish the clearance necessary to permit the two sets of shear lugs to pass through one another in the course of insertion and removal of the tether latch element from the base latch element. Means are provided for rotating the tether latch shear lugs into and away from alignment with one another as necessary in the course of insertion and removal. In a preferred embodiment, a bearing is provided in the tether latch element to permit the tether to pivot to a limited degree relative to the main body of the tether latch element. This accommodates the lateral displacement of the hull relative to the foundation occurring in response to environmental forces.

BRIEF DESCRIPTION OF THE DRAWINGS

For a better understanding of the present invention, reference may be had to the accompanying drawings, in which.

DESCRIPTION OF THE PREFERRED EMBODIMENT

Figure 2:
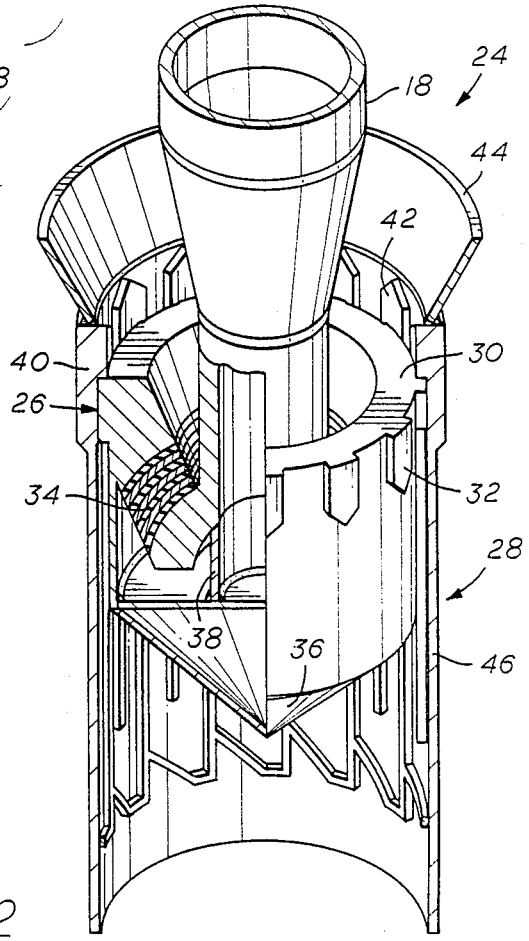
FIG. 2 shows an isometric, partially cut-away view of a preferred embodiment of the shear lug connector used as a tether base latch.

Shown in FIG. 2 is an isometric, partially cut-away view of a preferred embodiment of the tether connector of the present invention. As will become apparent in view of the following discussion, the preferred embodiment of the present invention is particularly well suited for use in securing the tethers of a tension leg platform (TLP) to a foundation at the ocean floor. However, the present invention is also useful in other applications in which it is desirable to secure a marine tether element to a structure. To the extent the preferred embodiments of the present invention, described below, are specific to securing a TLP tether to a foundation on the ocean floor, this is by way of illustration rather than limitation.

Figure 1:
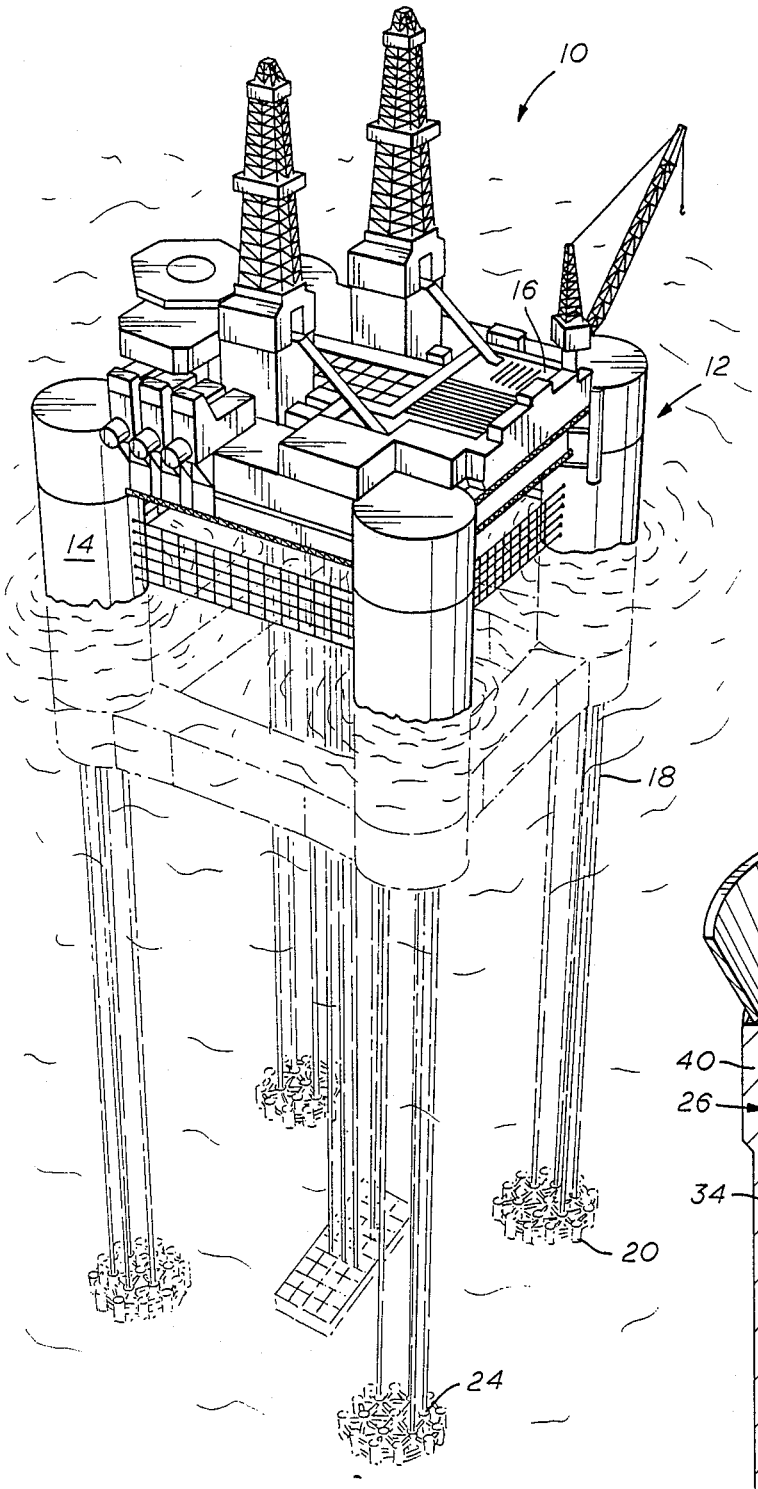
FIG. 1 is a perspective view of a tension leg platform incorporating tethers secured to an ocean floor foundation by the shear lug connector of the present invention.

As best shown in FIG. 1, a TLP 10 includes a main hull 12 having a plurality of buoyant columns 14 secured at their upper ends to a deck 16 from which oil and gas drilling and producing operations are conducted. Extending downward from each of the column 14 is a set of tethers 18 serving to secure the column 14 to a corresponding foundation template 20 at the ocean floor. The tethers 18 are tensioned to maintain the TLP hull 12 at a somewhat greater draft than would be the case were the tethers 18 not tensioned. The tensioned tethers 18 moor the TLP 10 in position above the foundation templates 20, substantially restraining the TLP 10 against excessive motion in response to waves, wind and ocean currents.

Figure 3:
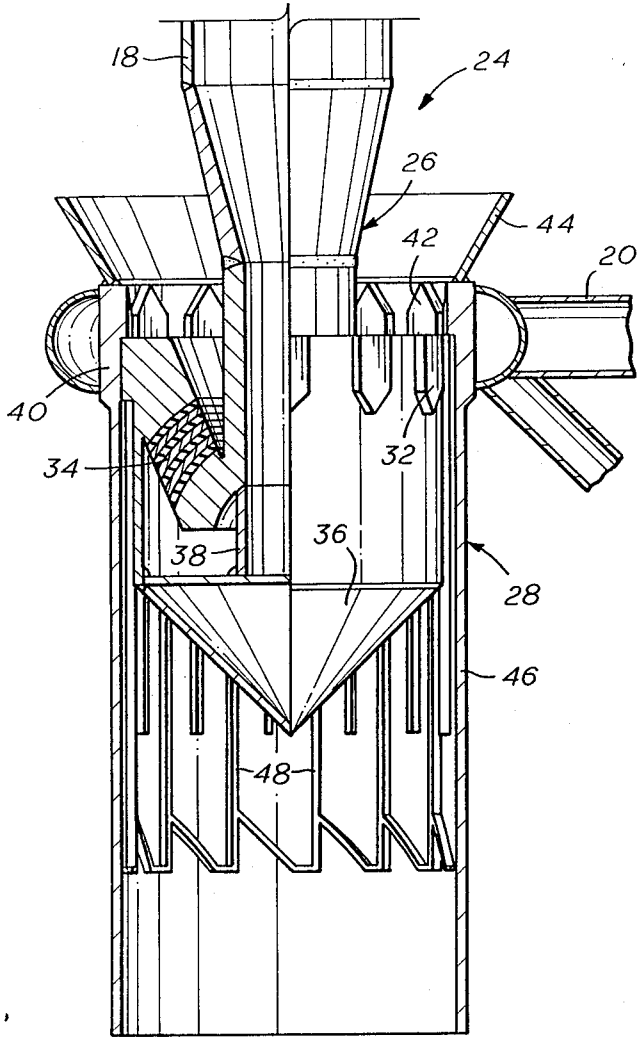
FIG. 3 is a view in axial cross-section of the connector of FIG. 2.

The tethers 18 are secured to the foundation templates 20 by the connectors 24 of the present invention. As best shown in FIGS. 2 and 3, each tether connector 24 includes a tether latch unit 26 secured to the lower end of the tether 18 and a base latch unit 28 secured to the foundation template 20. The tether latch unit 26 and the base latch unit 28 together serve as a stab type shear connector, permitting quick and simple connection and disconnection of the tether 18 to the foundation 20.

The tether latch unit 26 includes a load ring 30 with an annular array of shear lugs 32 secured to its outer surface. The load ring 30 is supported on the lower end of the tether 18 by a compressed elastomeric bearing 34. This bearing 34 permits the tether 18 to pivot to a limited degree about the load ring 30 to accommodate lateral motion of the hull 12 relative to the ocean floor. A stabbing cone 36 is secured to the load ring 30 to form the lower end of the tether latch unit 26. The stabbing cone 36 facilitates insertion of the tether latch unit 26 into the base latch unit 28. A preload cylinder 38 is situated intermediate the lowermost portion of the tether 18 and the stabbing cone 36 to bias the load ring 30 downward relative to the tether 18. This imposes a compressive preload on the elastomeric bearing 34. This prevents the elastomeric bearing 34 from being placed in tension during tether latching and unlatching operations.

The connector base latch unit 28 includes a load ring 40 having an annularly arranged set of shear lugs 42 projecting radially inward therefrom. A guide cone 44 projects upward from the load ring 40 to guide the tether latch unit 26 into the base latch unit 28 during tether connection. A shroud 46 extends downward from the load ring 40. As best shown in FIG. 3, The shroud 46 and load ring 40 are rigidly secured to the framework of the foundation template 20.

Figure 4:
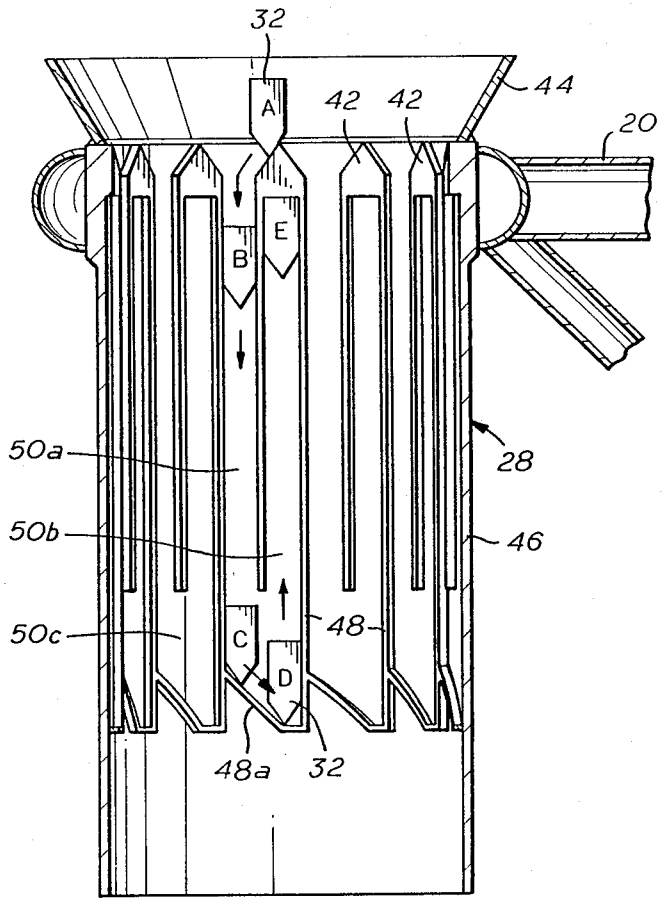
FIG. 4 is a view in axial cross section of the base latch unit showing the travel of a single shear lug as the tether latch unit is stabbed into the base latch and then locked within the base latch unit.

The tether latch and base latch units 26, 28 are configured to permit the tether latch unit 26 to enter and lock within the base latch unit 28 with a minimum of manipulation from the tether handling equipment in the hull 12. The bottom of each tether latch unit shear lug 32 and the top of each base latch unit shear lug 42 are tapered so that as the tether latch unit 26 is lowered into the base latch unit 28, the tether latch unit 26 will rotate until the stab unit shear lugs 32 are aligned to pass between the base latch unit shear lugs 42. As best shown in FIG. 4, the inner surface of the shroud 46 is provided with a set of guide rails 48 extending axially downward from the base latch unit shear lugs 42. These guide rails 48 establish two sets of channels 50*a*, 50*b*, as best shown in FIG. 4, which aid in guiding the tether latch unit 26 from initial insertion to the latched position. Corresponding to each base latch unit shear lug 42, there is a first channel 50*a* which extends downward from the space intermediate adjacent base latch unit shear lugs 42. A second channel 50*b* extends downward immediately beneath each of the base latch unit shear lugs 42. At the lower end of the two sets of channels 50*a*, 50*b* there is a transition area 50*c* where the tether latch unit shear lugs 32 can pass between the first and second channels 50*a*, 50*b*. A diagonally oriented turning guide rail 48*a* is positioned at the lower end of each set of channels 50*a*, 50*b*. The turning rails 48*a* cooperate with the tether latch unit shear lugs 32 to cause the tether latch unit 26 to rotate as it is lowered following initial contact between the tether latch unit shear lugs 32 and the turning rail 48*a*. This rotation automatically transfers each tether latch unit shear lug 32 from the first channel 50*a* to the second channel 50*b*. This automatic turning greatly simplifies tether connection. Once the tether latch unit 26 has been fully inserted into the base latch unit 28, it is merely necessary to lift the tether latch unit 26 until the abutment surfaces of the two sets of shear lugs 32, 42 come into contact. Following this, the tether 18 may be tensioned. FIG. 4 illustrates the sequence of positions a single tether latch unit shear lug 32 assumes in the course of inserting and latching the tether latch unit 32 within the base latch unit 42.

Removal of the tether 18 from the foundation template 20 is initiated by relieving the tether tension and lowering the tether until the tether latch unit shear lugs 32 contact the turning rails 48*a*. The tether 18 is then simultaneously rotated and lifted until the tether latch unit shear lugs 32 are within first channel 50*a*. The tether 18 is then lifted directly upward, removing the tether latch unit 26 from the base latch unit 28.

As best shown in FIG. 4, channels 50 are somewhat longer than is necessary to provide the necessary switching and alignment functions. This additional channel length serves to prevent damage or unlatching of the connector 24 in the event tether tension is reduced to the point where the tether latch 26 moves downward from the base latch 28. In the event the tension on a given tether 18 is reduced to this level, as might occur in an extreme storm condition, the tether latch 26 is free to move up and down relative to the base latch 28 with the tether latch shear lugs 32 riding in the second channels 50*b*. The length of the second channels 50*b* substantially avoids the possibility of the shear lugs 32 bottoming out against the turning rails 48*a*, which could damage the connector 24.

Figure 5:
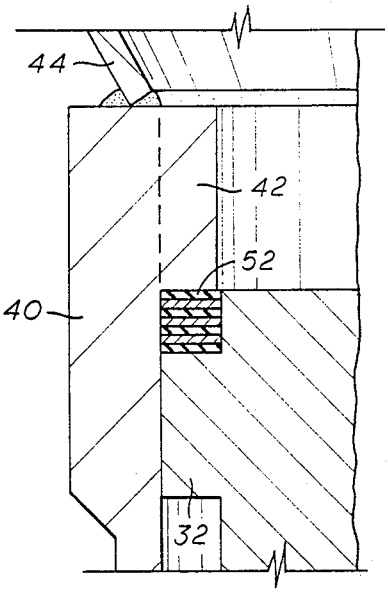
FIG. 5 is a detail of the shear lug interface illustrating the optional elastomeric bearing pads.

It is desirable to ensure that in operation of the connector 24 all abutting shear lug pairs transfer approximately the same loading. Unequal loading can result from manufacturing inaccuracies which cause one or more of the shear lug pairs to fail to come into abutment when the connector 24 is in use. Also, when the TLP hull 12 is displaced laterally from its neutral position as a result of wave and current loading, the loading axis imposed by each tether 18 on its corresponding connector 24 will be skewed with respect to the central axis of the connector base latch unit 28. This results in an asymmetric loading of the shear lug pairs 32, 42. To minimize loading imbalances between the shear lug pairs, elastomeric bearing pads 52 can be positioned at the interface between each pair of abutting shear lugs. In one embodiment, shown in FIG. 5, the bearing pads 52 are secured to the upper surface of each stab element shear lug 32. The bearing pads 52 would preferably be laminated with thin metal sheets to establish a high shape factor, increasing the maximum loading permitted for the elastomeric material.

Figure 6:
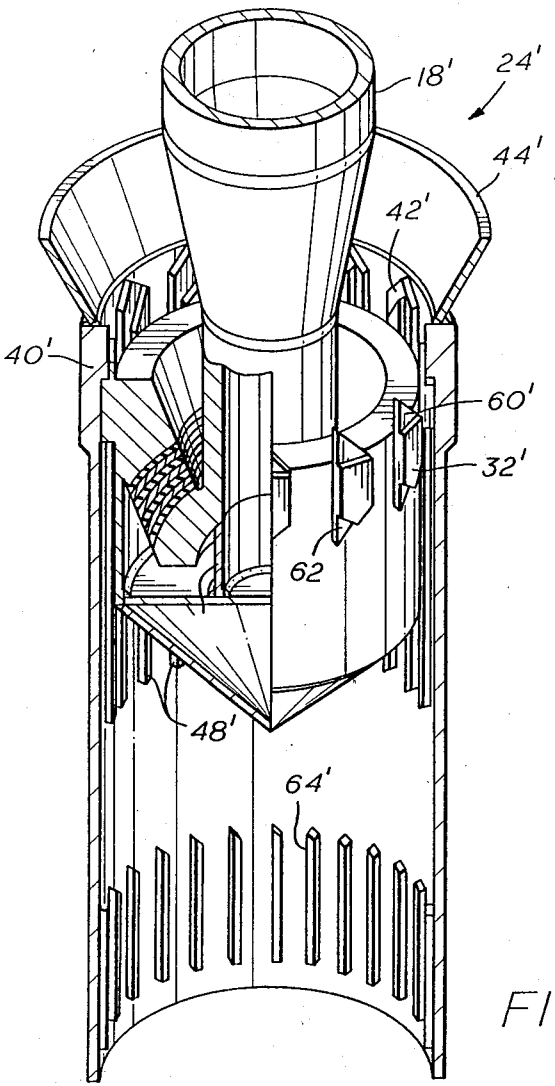
FIG. 6 is a view in axial cross section of a second embodiment of the present invention.

As previously discussed, the embodiment of the connector 24 shown in FIGS. 2–4 serves to automatically rotate the tether latch unit 26 into latching orientation with the base latch unit 28 as it is inserted into the base latch unit 28. To remove the tether 18, however, the tether latch unit 26 requires rotation in the opposite direction. The tether handling equipment in the hull 12 must be adapted to provide this function. It would be desirable to avoid the need for actively turning the entire tether 18 to unlatch the connector 24. FIG. 6 illustrates an embodiment of the present invention in which it is not necessary to actively rotate the tether 18' to unlatch the connector 24'. The embodiment shown in FIG. 6 differs from that discussed above only in the configuration of the tether latch unit shear lugs 32' and the guide rails 48'. As shown in FIG. 6, each tether latch unit shear lug 32' has an upper tab 60' and a lower tab 62' secured thereto. The upper tab 60' is positioned radially inward from the abutment surface of the tether latch unit shear lug 32' to prevent interference with seating of the shear lug pairs 32', 42'. A first set of guide rails 48' are provided to establish a first upper set of channels 50*a'* which extend vertically beneath each base latch unit shear lug 42' and second upper set of channels 50*b'* vertically beneath the space separating each base latch unit shear lug 42'. A second set of guide rails 64' forming a lower set of channels 66' is positioned a spaced distance beneath the first set of guide rails 48' and is rotated relative thereto an amount equal to one-half the arc subtended by each of the upper channels 50'.

Operation of this embodiment of the tether connector 24' can best be appreciated by a description of the latch-unlatch sequence. Initially, the tether latch unit 26' is lowered into the guide cone 44' of the base latch unit 28'. As the two sets of shear lugs 32', 42' approach, the inclined lower surface of each lower tab 62' contacts the tapered upper surface of the corresponding base latch unit shear lug 42'. This causes the tether latch unit 26' to rotate until its shear lugs 32' are aligned with the first upper set of channels 50*a'*. Further lowering of the tether latch unit 26' causes the tether latch unit shear lugs 32' to pass between the base latch unit shear lugs 42' and downward through the first upper channels 50*a'* until the inclined lower surface of the lower tab 62' contacts the upper end of the corresponding one of the lower guide rails 64'. Further lowering causes the tether latch unit 26' and tether 18' to rotate until the tether latch unit shear lugs 32' occupy the lower channels 66'. The tether 18' is then lifted until the upper tabs 60' contact the lower end of each upper guide rail 48'. This causes the tether latch unit 26' to rotate another increment, placing the shear lugs 32' in alignment with the second upper set of channels 50*b'*. The tether 18' is then lifted until the shear lugs sets 32', 42' come into abutment. The tether 18' is then tensioned.

Figure 7:
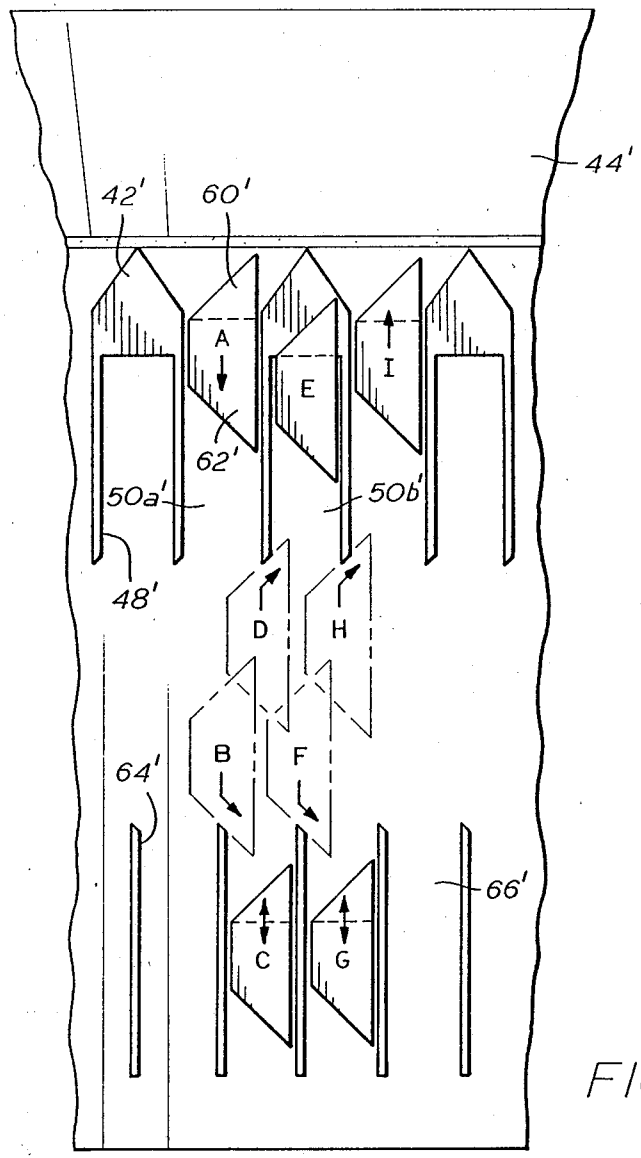
FIG. 7 shows the path of a single shear lug of the embodiment shown in FIG. 6 as it travels from an entry position to a latched position and then to an exit position These drawings are not intended as a definition of the invention, but are provided solely for the purpose of illustrating certain preferred embodiments of the invention, as described below.

To release the tether 18', the lower-lift sequence is repeated, transferring the tether latch unit shear lugs 32' from the upper first channels 50*a'* to the upper second channels 50*b'*. FIG. 7 is a diagram illustrating the sequence of positions through which a single tether latch unit shear lug 32' passes as the tether latch unit 26' is inserted, latched and then removed.

The embodiments of the tether connector 24 described above and illustrated in FIGS. 2–7 each achieve relative rotation of the two sets of shear lugs 32, 42 in unique manners. Those skilled in the art will appreciate that numerous other mechanical configurations are possible which will achieve the same result. It should be understood that the foregoing descriptions are illustrative only, and that other means and techniques can be employed without departing from the full scope of the invention as set forth in the appended claims.

We claim:

1. A connector for releasably securing a tension leg platform tether to a foundation on the ocean bottom, comprising:

a base latch element fixedly secured to said foundation, said base latch element defining a generally cylindrical recess having a substantially vertical axis, said base latch element including a plurality of shear lugs arranged in an annular array projecting radially inward a distance into said cylindrical recess, said shear lugs being spaced apart to define vertical passages between adjacent shear lugs;

a tether latch element secured to the lower end of said tether, said tether latch element having a main body sized to be received within said base latch recess, said tether latch element including a plurality of shear lugs secured to and projecting radially outward from said tether latch main body in an annular array, said tether latch shear lugs being sized and positioned to pass through said base latch element vertical passages to a position below said base latch element shear lugs, so that said tether latch element can be lowered into said base latch element;

first turning means for automatically rotating said tether latch element in response to axial movement of said tether latch element within said base latch element so as to cause said two sets of shear lugs to come into vertical alignment, whereby said connector can be latched by lowering said tether latch element into said base latch element and then raising said tether latch element to cause said two sets of shear lugs to come into shear abutment with one another, restraining said tether latch element from further upward displacement; and second turning means for automatically rotating said tether latch element in response to axial movement of said tether latch element within said base latch element after said two sets of shear lugs have been rotated into vertical alignment so as to cause said tether latch element shear lugs to return to alignment with said vertical channels, whereby said connector can be unlatched by lowering said tether latch element within said base latch element and then raising said tether latch element out of said base latch element.

2. The connector as set forth in claim 1 further including means for automatically aligning said tether latch lugs with said base latch vertical passages as said tether latch element is inserted into said base latch element.

3. The connector as set forth in claim 1 wherein said first turning means is adapted to cause said tether latch element to automatically relate in response to downward axial movement of said tether latch element.

4. The connector as set forth in claim 1 wherein said second turning means for automatically rotating said tether latch element in response to axial movement of said tether latch element within said base latch element is adapted to cause said tether latch element to rotate in response to axial lowering of said tether latch element after said two sets of shear lugs have been in shear abutment with one another.

5. A foundation and tether assembly for a tension leg platform comprising:

a foundation template secured to an ocean bottom location;

a base latch element secured to said foundation template, said base latch element including:

a load ring having a generally cylindrical inner surface, said load ring being so oriented that said cylindrical inner surface defines a generally vertical central axis; and a plurality of shear lugs secured to said load ring inner surface in a generally annular array, said shear lugs being laterally spaced one from another to define a vertical passage intermediate each adjacent pair of shear lugs;

a substantially vertical tether adapted to be secured at its upper end to a tension leg platform hull, said tether having a tether latch element at its lower end, said tether latch element being secured within said base latch element, said tether latch element including:

a main body sized to pass through said load ring; and a plurality of shear lugs secured to and projecting radially outward from said main body in an annular array generally concentric with said load ring central axis, said tether latch shear lugs being sized and positioned to pass through said base latch element vertical passages, so that said tether latch element can be lowered into said base latch element;

first turning means for automatically rotating said tether latch element in response to axial movement of said tether latch element within said base latch element so as to cause said two sets of shear lugs to come into vertical alignment, whereby said connector can be latched by lowering said tether latch element into said base latch element and then raising said tether latch element to cause said two sets of shear lugs to come into shear abutment with one another, restraining said tether from further upward displacement; and second turning means for automatically rotating said tether latch element in response to axial movement of said tether latch element within said base latch element after said two sets of shear lugs have been in shear abutment with one another so as to cause said tether latch element shear lugs to return to alignment with said vertical channels, whereby said connector can be unlatched by lowering said tether latch element within said base latch element and then raising said tether latch element out of said base latch element.

6. The foundation and tether assembly as set forth in claim 5 further including an elastomeric bearing secured at the interface intermediate said tether and said tether latch element main body, whereby said tether may pivot about said tether latch element.

7. The foundation and tether assembly as set forth in claim 5 further including means for automatically aligning said tether latch lugs with said base latch vertical passages as said tether latch element is inserted into said base latch element.

8. The foundation and tether assembly as set forth in claim 5 wherein said first turning means is adapted to cause said tether latch element to automatically rotate in response to downward axial movement of said tether latch element.

9. The foundation and tether assembly as set forth in claim 5 wherein said first turning means is adapted to cause said tether latch element to automatically rotate in response to (a) lowering said tether latch element downward through said vertical channels and then (b) lifting said tether latch element.

10. The foundation and tether assembly as set forth in claim 5 wherein said second turning means for automatically rotating said tether latch element in response to axial movement of said tether latch element within said base latch element is adapted to cause said tether latch element to rotate in response to axial lowering of said tether latch element after said two sets of shear lugs have been in shear abutment with one another.

11. The foundation and tether assembly as set forth in claim 5 wherein said second turning means for automatically rotating said tether latch element in response to axial movement of said tether latch element within said base latch element is adapted to cause said tether latch element to rotate in response to (a) axial lowering of said tether latch element after said two sets of shear lugs have been in shear abutment with one another and then (b) axial lifting said tether latch element.

12. The foundation and tether assembly as set forth in claim 5 wherein said tether latch element shear lugs are each provided with an elastomeric bearing surface at their upper end.

13. A foundation and tether assembly for a tension leg platform, comprising:

a base latch element fixedly secured to said foundation, said base latch element defining a generally cylindrical recess having a substantially vertical axis, said base latch element including a plurality of shear lugs arranged in an annular array projecting radially inward a distance into said cylindrical recess, said shear lugs being spaced apart to define vertical passages between adjacent shear lugs; and a tether latch element secured to the lower end of said tether, said tether latch element having a generally cylindrical main body with a tapered lower end, said main body being sized to pass through the region defined by the radially inner surface of said base latch shear lugs, said tether latch element having a plurality of shear lugs projecting radially outward from said main body, said tether latch element shear lugs being sized and positioned to pass through said base latch element vertical passages;

said base latch and tether latch elements being provided with first turning means for automatically rotating said tether latch element in response to axially lowering said tether latch element into said base latch element, said rotation occurring about said vertical axis and being sufficient to place at least a portion of said tether latch element shear lugs in vertical alignment with said base latch element shear lugs, whereby in response to inserting said tether latch element into said base latch element and then lifting said tether latch element, said tether latch element shear lugs come into shear abutment with said base latch shear lugs, restraining further upward movement of said tether latch element; and second turning means for automatically rotating said tether latch in response to axial movement of said tether latch element within said base latch element after said two sets of shear lugs have been in shear abutment with one another, said rotation occurring about said vertical axis and being sufficient to return said tether latch element shear lugs to alignment with said vertical channels, whereby said connector can be unlatched by lowering said tether latch element and then raising said tether latch element out of said base latch element.

14. The foundation and tether assembly as set forth in claim 13 further including an elastomeric bearing secured at the interface intermediate said tether and said tether latch element main body, whereby said tether may pivot about said tether latch element.

15. The foundation and tether assembly as set forth in claim 13 further including means for automatically aligning said tether latch lugs with said vertical passages as said tether latch element is inserted into said base latch element.

16. The foundation and tether assembly as set forth in claim 13 wherein said second turning means for causing said tether latch element to automatically rotate so that said tether latch element shear lugs return to alignment with said vertical channels in response to axial movement of said tether latch element within said base latch element is adapted to cause said tether latch element to rotate in response to axially lowering said tether latch element after said two sets of shear lugs have been in shear abutment with one another.

17. The foundation and tether assembly as set forth in claim 13 wherein said tether latch element shear lugs are each provided with an elastomeric bearing surface at their upper end.

18. The connector as set forth in claim 1 wherein said first turning means is adapted to cause said tether latch element to automatically rotate in response to (a) axially lowering said tether latch element downward through said vertical channels and then (b) raising said tether latch element.

19. The connector as set forth in claim 1 wherein said second turning means for automatically rotating said tether latch element in response to axial movement of said tether base latch element within said base latch element is adapted to cause said tether latch element to rotate in response to (a) lowering said tether latch element after said two sets of shear lugs have been in shear abutment with one another and then (b) raising said tether latch element, so as to cause said tether latch element shear lugs to return to alignment with said vertical channels, whereby said connector can be unlatched by lowering said tether latch element within said base latch element and then raising said tether latch element out of said base latch element.

* * * * *